US005771663A

United States Patent [19]

Wold et al.

[11] Patent Number: 5,771,663

[45] Date of Patent: Jun. 30, 1998

[54] METHOD FOR MANUFACTURING COMPRESSED FLUID CONTAINERS, METHOD FOR MANUFACTURING EVACUATED CONTAINERS

[75] Inventors: Benjamin N. Wold, Scottsdale, Ariz.; John H. Cover, Coronado, Calif.

[73] Assignee: Air Taser, Inc., Scottsdale, Ariz.

[21] Appl. No.: 566,350

[22] Filed: Dec. 1, 1995

(Under 37 CFR 1.47)

[51] Int. Cl.[6] ..... B65B 31/00

[52] U.S. Cl. ..... 53/403; 53/404; 53/405; 53/79; 53/80; 141/82; 141/326

[58] Field of Search ..... 53/403, 404, 405, 53/79, 80, DIG. 3; 141/82, 11, 325, 326

[56] References Cited

U.S. PATENT DOCUMENTS

| | | | |
|---|---|---|---|
| 1,726,111 | 8/1929 | Loewe | 53/405 |
| 2,262,176 | 11/1941 | Geiger et al. | 53/404 |
| 2,951,321 | 9/1960 | Sennett | 53/DIG. 3 |
| 3,512,243 | 5/1970 | Suzuki et al. | 53/79 |
| 3,924,382 | 12/1975 | Overkott | 53/403 |
| 4,109,820 | 8/1978 | Stifano | 53/403 |
| 4,452,377 | 6/1984 | Hurley et al. | 141/18 |
| 5,083,415 | 1/1992 | Schneider et al. | 53/403 |

FOREIGN PATENT DOCUMENTS

| | | | |
|---|---|---|---|
| 197809 | 9/1978 | Japan | 53/79 |

*Primary Examiner*—James F. Coan
*Assistant Examiner*—Gene Kim
*Attorney, Agent, or Firm*—Cherskov & Flaynik

[57] ABSTRACT

A method for producing a compressed fluid container is provided comprising charging a container with a fluid while simultaneously sealing the container. A double-walled compressed gas cylinder is also provided.

9 Claims, 2 Drawing Sheets

METHOD FOR MANUFACTURING COMPRESSED FLUID CONTAINERS, METHOD FOR MANUFACTURING EVACUATED CONTAINERS

BACKGROUND OF THE INVENTION

1. Field of the Invention

The present invention relates to a method for manufacturing compressed fluid containers, and more specifically the present invention relates to a method for manufacturing compressed gas and liquid/gas mixture cylinders. The present invention also relates to a method for producing evacuated containers.

2. Background of the Invention

Uses for portable compressed fluids are widespread, and include their incorporation in self contained breathing apparatuses, compressed-air charged fire arms, and compressed fluid-charged spray configurations to facilitate chemical aerosolization and dispersion.

A myriad of methods for constructing containers containing compressed fluid exist. One method, U.S. Pat. No. 3,924,382 to Overkott, consists of first placing a container in an enclosure, charging the enclosure with a gas, mechanically pressing a cap over the opening of the container, removing the enclosure, and then sealing the cap to the container. This process, and other similar processes, requires expensive and time consuming welding procedures. The process also requires the use of a mechanical press or some other means to keep the two pieces tightly sealed just prior and during the welding process.

A need exists in the art for a process for manufacturing compressed fluid containers that overcomes the shortcomings of the prior art. Such a process should include a rapid set-up procedure and employ a rapid method of sealing the fluid, which comprises a gas or a liquid-gas mixture, in the container during charging, and without resorting to expensive welding.

SUMMARY OF THE INVENTION

An object of the present invention is to provide a method for constructing a compressed fluid container that overcomes many of the disadvantages of the prior art. The fluid can consist of a gas or a liquid-gas mixture.

Another object of the present invention is to provide an economical method for constructing a compressed fluid container. A feature of the invention is the utilization of heat conductance to seal the container. An advantage of the invention is the elimination of expensive welding to seal the container.

Yet another object of the present invention is to provide a simplified method for producing compressed fluid containers. A feature of the invention is the sealing of the container during pressurization. An advantage of the invention is the ability to seal the container or a plurality of containers almost instantly after charging the containers with fluid.

Still another object of the present invention is to economically provide a more resilient compressed gas cylinder. A feature of the invention is the of nesting of one container into another similarly geometrically shaped container. An advantage of the invention is the resulting double-walled configuration that provides added strength, durability and therefore safety associated with the use of the compressed gas cylinder.

Another object of the present invention is to provide a method for producing an evacuated or partially evacuated container. A feature of the invention is the sealing of the container during fluid evacuation. An advantage of the invention is minimization of steps required to construct an evacuated container, such as a vacuum cylinder.

Briefly, the invention provides for a method to produce a compressed fluid container comprising charging a container with a fluid while simultaneously sealing the container. The invention also provides for a double walled compressed gas cylinder, and a double walled evacuated or partially evacuated container. Thirdly, the invention provides for a method to produce an evacuated container comprising creating a partial vacuum in a container while simultaneously sealing the container.

BRIEF DESCRIPTION OF THE DRAWING

The present invention together with the above and other objects and advantages may be understood from the following detailed description of the embodiment of the invention illustrated in the drawings, wherein.

DETAILED DESCRIPTION OF THE INVENTION

Generally, the method calls for sealing a container via heat conduction while the container is charged with pressurized fluid. The process also allows for evacuating a container and maintaining a vacuum or partial vacuum in a container simultaneous with the cylinder being sealed.

A myriad of container shapes are applicable, including but not limited to, cylinders, spheres, cones, cubes, cuboids, and other receptacle types.

Figure 1A:
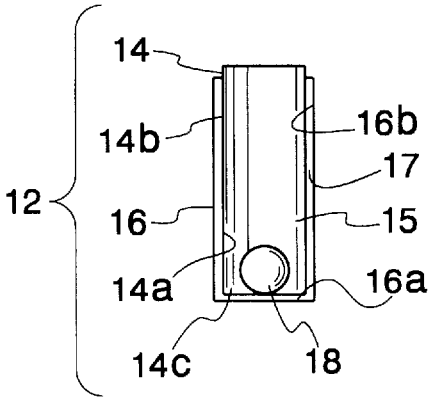
FIGS. 1A–D is a simplified flow chart diagram of the invented method, in accordance with the present invention.

FIGS. 1A–D depicts one embodiment of the invented method. FIG. 1A illustrates an unsealed cylinder assembly 12 comprising a first body, such as a casing or cup 14 having a first open end 14*c* with a predetermined diameter and a second, closed end. The first cup 14, generally cylindrically shaped and of a first predetermined diameter, is slidably received by a generally cylindrically shaped second body, such as a casing or cup 16 having a diameter larger than the first predetermined diameter, the first cup to be so received along the longitudinal axis of the second cup 16 so as to form an enclosed chamber 15 defined by an inner wall 14*a* of the first cup 14 and a lower planar surface 16*a* of the second cup 16. The configuration also forms an annular space 17 defined by the outer cylindrical wall surface 14*b* of the first cup 14 and the inner cylindrical wall 16*b* of the second cup 16. Prior to formation of the enclosed chamber space by the juxtaposition or nesting of the first and second cups, a piece of sealing material 18 is placed at the lower or bottom surface of the second cup 16.

Figure 1B:
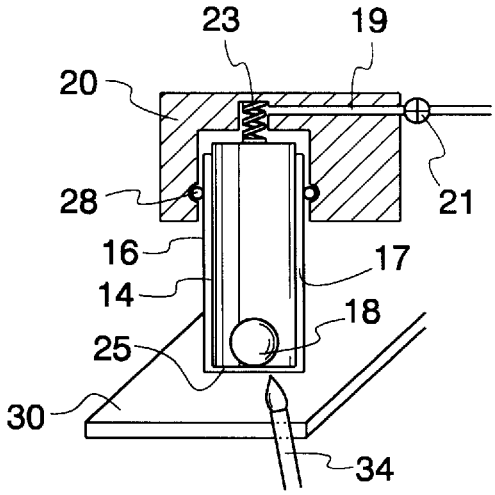

As depicted in FIG. 1B, the unsealed cylinder assembly 12 is adapted to be received by a fluid charging means 20 so as to form a fluid-tight seal between the unsealed cylinder assembly 12 and the fluid charging means 20. FIG. 1B depicts the gas-tight seal as being formed between outside surface of the second cup 16 and the fluid charging means 20. The fluid charging means 20 further comprises a means 19 for directing a pressurized fluid to the chamber 15. Fluid flow is effected via a means 21 for regulating fluid such as a valve.

Figure 1C:
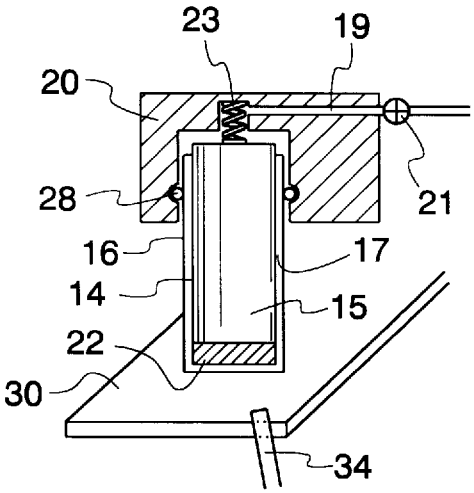

Upon charging the chamber 15 with the desired fluid, the sealing substrate 18 is thermally treated so as to liquify or otherwise change phase and thereby take the shape of a sealing region 25, defined by a lower region of the first cup 14 forming the first open end 14*c* or aperture and the surrounding inside bottom surface, (in this case the lower planar surface 16*a*) and the inside upwardly directed surfaces (in this case the inner cylindrical wall 16*b*) of the second cup 16. As depicted in FIG. 1C, the liquified sealing substrate 22, must be of sufficient quantity to completely immerse the mouth of the first cup 14, and therefore prevent fluid transfer from the chamber 15 when the sealing substrate is allowed to resolidify. As such, the amount of the sealing substrate needed will be determined by the volume of the sealing region 25.

Figure 1D:
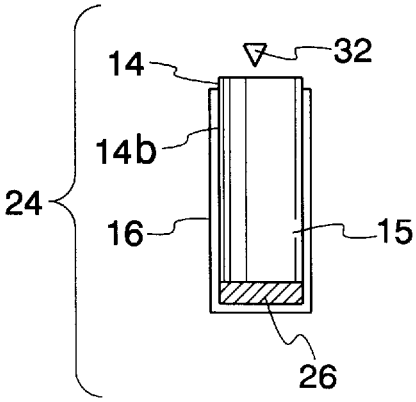

The liquified sealing substrate 22 is allowed to solidify into a solid mass 26, or otherwise change into a denser phase, after which the fluid charging means 20 is uncoupled to leave a sealed, charged air cylinder assembly 24, depicted in FIG. 1D.

During the filling or introduction of a gas or liquid-gas mixture into the enclosure 15, a means for positioning and stabilizing the first cup is provided, partly for preventing premature cut-off or hinderance of the passage of the charging fluid. One such positioning and stabilizing means is depicted in FIGS. 1B and 1C as a spring 23 or other reversibly deformable material. The spring 23 is positioned so as to prevent the first cup 14 from moving toward or proximal with the means for directing the pressurized fluid 19 during charging. Obviously, the positioning and stabilizing means should be suitable to withstand the pressures that the configuration will be subjected to during the compression procedure, outlined supra. Also, depending on the operation to be performed, the positioning and stabilizing means 23 is adjustable so that when evacuation of the enclosure 15 is desired, more tension can be placed on the positioning and stabilizing means during the initial phases of evacuation, with less tension applied during the final stages of evacuation, so as to allow the enclosed end of the first container 14 to occlude the fluid charging means 19 during sealing.

Also during compression procedures, the position of the second body or cup 16 must be determined by a means for positioning and restraining the cup 16 so as to prevent the cup 16 from becoming a projectile during fluid charging procedures. While the O-ring configuration 28 serves to position and hinder sudden movements of the second body 16, a means to retain the second body, such as a surface, in this instance a moveable platform 30, will also enhance the safety characteristics of the invented method. The platform 30 is configured so as not to hinder phase change treatment of the sealing substrate. The platform 30 is also configured to streamline the fluid charging process by moving the container configuration 12 into position with the fluid charging means 20, for charging. After compression and sealing is complete, the platform moves the now-charged container 24 out of position so as to accommodate another uncharged configuration 12 waiting upstream in the manufacturing process. Alternatively, a surface stabilizing the second body 16 is stationary while the fluid charging means 20 moves from one uncharged configuration 12 to the next.

Sealing Material Detail

A novel feature of the charging process is the use of heat conduction to form a gas-tight or a liquid/gas tight seal. The resulting seal integrally molds together the first and second cup into a single unit.

A myriad of sealing materials or sealants that are generally reflowable materials are suitable for use in the invented method, including, but not limited to solder, braze, plastic or glass. Specific solder alloys which have produced good results include 50 percent Sn/50 percent Pb manufactured by Lucas Milhaupt of Cudahy, Wis. The suitable melting point of these sealing materials will vary, and can be between approximately 183°–316° C. for soldering substrates, and between approximately 520°–1,200° C. for brazing materials. Generally, the sealing substrates are selected to not surpass the melting temperature of the container substrate.

Another unique feature of the invention is the application of heat from an isolated heating means 34, so that the sealing material does not contact directly the heating means, but rather, the sealing material changes phase through heat conduction. This sealing method renders the entire process more safe than typical methods, particularly when the fluid being compressed is somewhat volatile or flammable.

Means for applying heat can vary. Electric arcs, induction heating, and the use of open flames produced from a variety of sources, such as acetylene combustion are suitable heating means. Acetylene flame is particularly preferable, given its already ubiquitous use and also that its 4,000°–5,000° C. temperature provides for very rapid (approximately three seconds) liquification of sealant.

Sealing substrate melt temperatures are also attained through induction heating, whereby a magnetic field is used to generate heat. The inventors have found that induction units, available through Magnaforce (Warren, Ohio) produce adequate amounts of heat, so as to change the phase of the sealing substrate, in from 1 to 10 seconds. Duration of heat application will vary with the sealing substrate selected. If rapid application of heat is utilized, followed by rapid cooling, any expansion of the charging fluid is minimized, thereby minimizing the formation of any fissures in the seal caused by out-gassing of the fluid from the enclosure 15. Applications of heat or other means to change the phase of the sealing material are generally adjacent to the sealing region 25.

Fluid Charging

Means Detail

The charging fluid can be in either liquid phase, vapor phase, or a liquid-vapor mixture. A myriad of gases can be compressed by this method, including but not limited to those selected from the group consisting of $H_2$, $O_2$, $CO_2$, $N_2$, Ar, He, $NH_3$, $Cl_2$ air and combinations thereof. Liquid-vapor mixtures suitable for compression include heterogeneous mixtures such as combined fractions of petroleum distillates, and aerosolized liquids combined with inert (noble) or noninert carrier gases, such as chlorofluorocarbons. Homogeneous liquid-vapor mixtures suitable for compression with the invented method include chemical feed stock compounds such as the lower and middle-fraction alkane and alkene fractions susceptible of easy volatilization. As such, the charging fluid also can consist, even partially, of the actual material being dispensed, such as chemicals designed for widespread application (fire extinguishing materials, pesticides, fertilizers, dispersion of bacteriologics, other agricultural uses), mace, paint, and personal care products. The method is also suitable for the compressed containment of gas/solid mixtures, such as pepper spray and dog repellent compounds, The invented method produces a compressed fluid container able to contain pressurized fluids up to approximately 2,500 pounds per square inch (psi). Therefore, proced ures of charging the container also must accommodate this maximum pressure. Generally, the temporary seal betwee n the charging means 20 and the cylinder assembly 12 must be able to withstand pressures up to 2,500 psi. Such a gas-tight seal is effected in a myriad of ways, including, but not limited to, an O-ring configuration, a snap-tight connection, or a male-female threaded assembly. FIGS. 1B and 1C depict an O-ring configuration whereby an O-ring 28 effects a gas-tight seal by being compressed or mechanically, reversibly deformed against the outside surface of the second cup 16, a depending portion of the fluid pressure means 20, and a means 30 to guide the unsealed cylinder assembly 12 into a position to be received by the fluid pressure means 20.

EXAMPLE 1

The process for producing a compressed gas cylinder, as depicted in FIG. 1, requires approximately 5 seconds to complete. An exemplary application of the invented process depicted in FIG. 1 is to produce compressed air cylinders which are used in an electronic incapacitation device, commonly known as a stun gun, to propel electrically charged probes at an assailant. One such self defense device is manufactured specifically under U.S. trademarks Taser® and Air Taser®. Other applications include the production of air cartridges for small-caliber weapons, the production of compressed cylinders for spray devices, and the production of $CO_2$ cartridges for use in home soda-water manufacture.

Generally, the cylinder is comprised of a substrate that can withstand pressures of up to approximately 2,800 psi without deformation or breach. Substrates that exhibit good pressure tolerance include cold formed steel, and heat formed steel. While a myriad of cylinder volumes of between 1 ml to 10 liters can be accommodated by the process, the instant example deals with cylinder volumes of 1 milliliter.

The choice of container substrate, sealing substrate and heating means will vary the time required for sealing substrate phase change. Such times are determined and confirmed by the use of an infrared pyrometer, after which average heating times are incorporated into a manufacturing process protocol.

EXAMPLE 2

Figure 2:
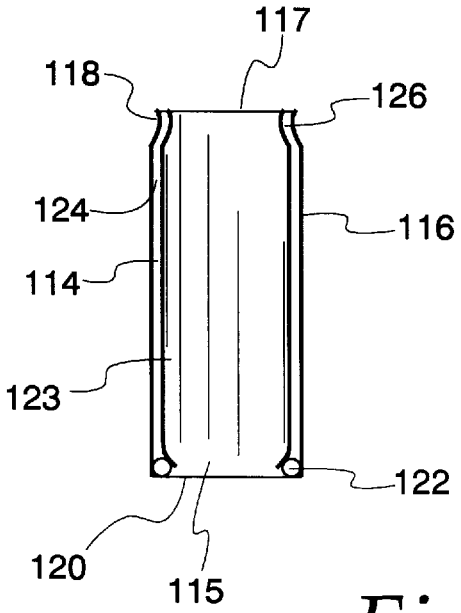
FIG. 2 is an elevated partial cutaway view of a double walled compressed gas cylinder, in accordance with the present invention.

Another embodiment of the two walled compressed fluid cylinder is depicted in FIG. 2 whereby no reflowable sealing substrate is utilized. Rather, a first housing 114 having a first open end 115 and a second closed end 117, and with a predetermined geometrical configuration and size is nested into a second, larger housing 116 which has a first opened end 118 and a second closed end 120. Prior to the nesting procedure, the periphery of the inside end surface of the housing 116 is outfitted with a means to removably seal the second housing to the first housing. A myriad of seals can be utilized, with FIG. 2 depicting the use an O-ring 122 to effect such a seal.

After the first and second housings are placed in the nesting configuration as depicted, an enclosed space 123 is defined comprising the inside surfaces of the first housing, and the inside surface of the closed end of the second housing. This enclosed space 123 is adapted to receive and contain a pressurized fluid from a means to provide pressurized fluid similar to means 20 depicted in FIG. 1. Transport of the pressurized fluid to the enclosed space 123 is facilitated through an annular or peripheral space 124 defined by the outside surface of the sides of the first housing and the inside side surfaces of the second housing. The inventors have found that the enclosed chamber is able to be pressurized even while the first housing 114 is in place against the O-ring. Therefore, the configuration can be, but does not have be, pressurized prior to the housing 114 contacting the O-ring.

After fluid charging, the closed end 117 of the first housing 114 is integrally molded to the juxtaposed open end 118 of the second housing 116 so as to effect a fluid-tight seal in the region 126 defined by the juxtaposed surfaces. A myriad of methods for effecting the fluid-tight seal is suitable, including, but not limited to crimping the housings together, soldering or employing an adhesive or two-part catalyst sealing system to the area 126 defined by the juxtaposed surfaces. A third method for forming a seal is to place sealing substrate, similar to the type used in the process depicted in FIG. 1 in the juxtaposed region 126 and then thermally treating the substrate to cause the substrate to partially melt and take on the shape of the confining region 126. Also, a combination of crimping or mechanical deformation, and solder sealing is suitable.

EXAMPLE 3

Figure 3:
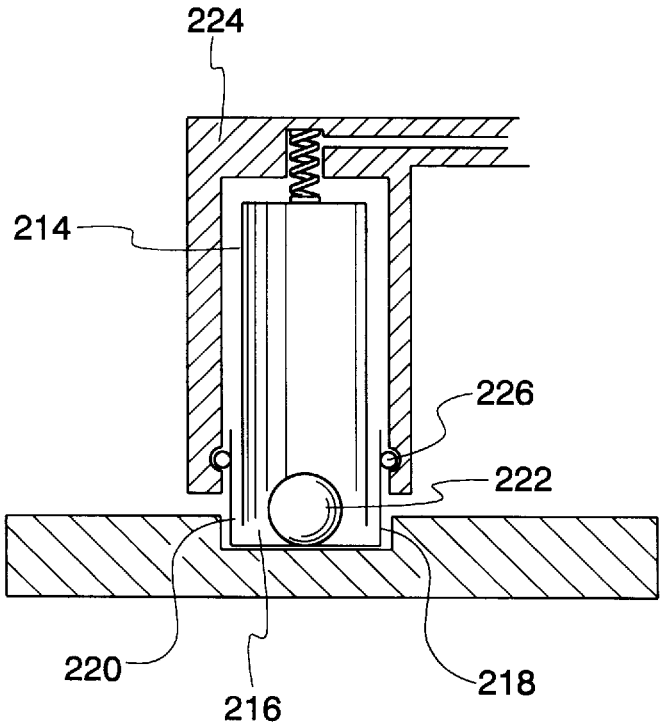
FIG. 3 is an elevated, cutaway view of a single-walled compressed gas cylinder, prior to sealing, in accordance with the present invention.

Instead of producing an enclosed chamber 15 from two capsules whereby one capsule slideably receives the other, a compressed gas configuration can be constructed of a single casing as depicted in FIG. 3. A container or first housing portion 214, having a lower end defining a first opening 216 or aperture is arranged with the periphery of the opening 216 downwardly depending so as to contact an inner surface of a cap or second housing portion 218. The second housing portion 218 is geometrically similar to the shape of the first housing portion, but with a larger diameter so as to form peripheral a space 220 (annular in this instance) between the inside surfaces of the cap and the outside surfaces of that region and adjacent region of the first housing portion that forms the lip of the open end of the cylinder. A sealing substrate 222 is placed in the second housing prior to the nesting of the first housing inside the second housing.

The entire arrangement, as depicted in FIG. 3, is then be placed in a pressurized environment produced by a means for supplying pressurized fluid 224. A transient fluid-tight seal 226, is obtained, similar to the seal taught by the process depicted in FIG. 1, such as by an O-ring configuration between the outside surface of the second housing and the means for supplying the pressurized fluid. Heating of the sealing substrate occurs from outside of the pressurized environment.

An advantage of the embodiment depicted in FIG. 3 is minimization of materials required to construct a compressed fluid cylinder.

In the procedure for producing an evacuated container, the same arrangement depicted in FIGS. 1–3 is employed, except that the pressurized fluid means 20 is supplanted with an evacuation means, (not shown). Depending on the evacuation means, containers defining an enclosure or space devoid of almost all fluid can be produced. For example, measured in relation to air pressure (760 mm), partial vacuums of 7.00 mm Hg, and 0.001 mm Hg are typically produced using water pumps and mercury pumps, respectively. Pressures that are magnitudes lower also can be obtained, depending on the evacuation means.

In operation, the resulting compressed fluid container or evacuated cylinder is juxtaposed with a means 32 to access the enclosure 15. Such an access means can be selected from a tap, a piercing needle or a thermal lance. Generally, access is made from a portion of the sealed configuration 24 that is thin walled, such as the single walled end of the first enclosure 14, so depicted in FIG. 1D.

While the invention has been described with reference to details of the illustrated embodiment, these details are not intended to limit the scope of the invention as defined in the appended claims.

The embodiment of the invention in which an exclusive property or privilege is claimed is defined as follows:

1. A method for producing a compressed fluid container comprising the steps of:

a) selecting a first casing having a first end that defines an opening and a second end that is closed;

b) placing a second casing in said first casing to define an enclosed chamber, said second casing having a first end that defines an opening and a second end that is closed, said opening of said first end of said second casing being smaller than said opening of said first end of said first casing;

c) charging said defined enclosed chamber with a fluid; and d) sealing said open first end of said first casing whereby said first end of said first casing and said second end of said second casing are integrally joined, wherein the step of sealing said open first end of said first casing includes the steps of:

e) selecting a solidified substrate, said substrate selected from the group consisting of metal, solder, braze, plastic or glass;

f) liquifying the substrate so as to completely engulf the open end of the second casing and closed end of the first casing; and g) allowing the substrate to solidify.

2. The method as recited in claim 1 wherein the step of liquifying the substrate includes the step of heating the substrate through conduction.

3. The method as recited in claim 2 wherein the step of heating the substrate includes the step of utilizing acetylene combustion as the source of heat.

4. The method as recited in claim 1 wherein the step of liquifying the substrate includes the step of heating the substrate by magnetic induction.

5. The method as recited in claim 2 wherein the step of heating the substrate includes the step of timing the substrate to liquify between approximately 1 second and 10 seconds.

6. The method as recited in claim 1 wherein the step of sealing said first end of said first casing includes the step of mechanically crimping a perimeter portion of said second end of said second casing to a perimeter portion of said open end of said first casing.

7. The method as recited in claim 1 wherein the step of sealing said first end of said first casing includes the step of utilizing a sealant in combination with mechanically crimping a perimeter portion of said second end of said second casing to a perimeter portion of said open end of said first casing.

8. A method for producing a compressed fluid container comprising the steps of:

a) selecting a first casing having a first end that defines an opening and a second end that is closed;

b) placing a second casing in said first casing to define an enclosed chamber, said second casing having a first end that defines an opening and a second end that is closed, said opening of said first end of said second casing being smaller than said opening of said first end of said first casing;

c) charging said defined enclosed chamber with a fluid;

d) sealing said open end of said first casing whereby said first end of said first casing and said second end of said second casing are integrally joined, wherein the step of sealing said open end of said first casing includes the steps of:

e) liquifying a solidified substrate so as to completely engulf the open end of the second casing and closed end of the first casing; and f) allowing the substrate to solidify.

9. The method as recited in claim 8 wherein the substrate is selected from the group consisting of metal, solder, braze, plastic or glass.

* * * * *